US007293846B2

(12) United States Patent
Collins et al.

(10) Patent No.: US 7,293,846 B2
(45) Date of Patent: Nov. 13, 2007

(54) STORAGE BIN ASSEMBLY FOR A REFRIGERATOR

(75) Inventors: Clint J. Collins, Bondurant, IA (US); Scott W. Leimkuehler, Swisher, IA (US); Jonathan J. Tiemeier, Cedar Rapids, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 256 days.

(21) Appl. No.: 10/964,705

(22) Filed: Oct. 15, 2004

(65) Prior Publication Data

US 2006/0082270 A1 Apr. 20, 2006

(51) Int. Cl.
*A47B 96/16* (2006.01)

(52) U.S. Cl. ..... 312/405.1; 312/404; 312/321.5; 312/348.4; 312/365.6; 220/661

(58) Field of Classification Search ..... 312/405.1, 312/404, 407, 407.1, 321.5, 265.5, 265.6, 312/327, 328, 406.2, 408; 220/661, 345.1, 220/676, 677, 811, 812, 813
See application file for complete search history.

(56) References Cited

U.S. PATENT DOCUMENTS 2,297,859 A * 10/1942 Anderson ..... 62/286
2,898,173 A * 8/1959 Squire ..... 312/248
3,647,075 A * 3/1972 Aue ..... 211/153
3,937,537 A * 2/1976 Dietterich ..... 312/204
4,186,978 A * 2/1980 Thomson ..... 312/321.5
4,221,302 A * 9/1980 Kupersmit ..... 220/4.31
4,478,005 A * 10/1984 Mundschenk ..... 49/388
4,502,609 A * 3/1985 Christatos ..... 220/3.8
4,557,118 A * 12/1985 Pink et al. ..... 62/382
4,624,509 A * 11/1986 Ramsey ..... 312/234.5
4,801,182 A * 1/1989 Metcalfe et al. ..... 312/321.5
4,867,512 A * 9/1989 Wilkins et al. ..... 312/245
5,004,305 A * 4/1991 Montuoro et al. ..... 312/405.1
5,040,856 A * 8/1991 Wilkins et al. ..... 312/402
5,100,213 A 3/1992 Vandarakis et al.
D344,739 S 3/1994 Edman et al.
5,322,366 A * 6/1994 Revlett et al. ..... 312/405.1
5,327,682 A * 7/1994 Holtz ..... 49/463
5,346,299 A * 9/1994 Werkmeister et al. ... 312/405.1

(Continued)

FOREIGN PATENT DOCUMENTS

JP 03168575 7/1991

(Continued)

*Primary Examiner*—Lanna Mai
*Assistant Examiner*—Mart K Kuhn
(74) *Attorney, Agent, or Firm*—Michael D. Lafrenz; Kirk Goodwin

(57) ABSTRACT

A refrigerator includes a storage bin assembly removably mounted to an inner liner of a door. The storage bin assembly includes a base portion having a frontal opening, and a face portion. The frontal opening is defined by first and second side portions, as well as a bottom portion. Each of the side portions is provided with a mounting component and a mounting element. The face portion includes top, bottom and opposing side sections, with each of the opposing side sections being provided with a mounting member and a mounting part. The mounting component interengages with the mounting member and the mounting element interengages with the mounting part upon snap-fittingly securing the face portion to the base portion across the frontal opening.

19 Claims, 12 Drawing Sheets

U.S. PATENT DOCUMENTS 5,375,924 A * 12/1994 Pohl et al. ..... 312/405.1
5,437,503 A * 8/1995 Baker et al. ..... 312/404
5,584,549 A * 12/1996 Lybarger et al. ..... 312/265
5,605,246 A * 2/1997 Rausch et al. ..... 220/555
5,921,648 A * 7/1999 Rong ..... 312/348.4
5,951,134 A 9/1999 Braun et al.
5,996,831 A * 12/1999 Teok ..... 220/230
6,085,542 A 7/2000 Johnson et al.
6,231,146 B1 * 5/2001 Dang ..... 312/405.1
6,997,526 B2 * 2/2006 Leimkuehler et al. ... 312/321.5
2003/0020384 A1 * 1/2003 Bush et al. ..... 312/348.4
2003/0020385 A1 1/2003 Leimkuehler et al.
2004/0108318 A1 * 6/2004 Wang ..... 220/345.2

FOREIGN PATENT DOCUMENTS

JP 11237173 8/1999

* cited by examiner

STORAGE BIN ASSEMBLY FOR A REFRIGERATOR

BACKGROUND OF THE INVENTION

1. Field of the Invention

The present invention pertains to the art of refrigerators and, more particularly, to a storage bin assembly for retaining articles on a door of a refrigerator.

2. Discussion of the Prior Art

It is well known in the art of refrigerated appliances to form doors having inner liners that are provided with structure to support storage units for retaining various food containers. Typically, the storage units are in the form of fixed or removable bins that are supported by the door. The removable bins can be arranged at various positions on the inner liner to provide adequate spacing for food items and containers having varying heights.

In many cases, the bins are of a unitary construction and typically injection molded from plastic. In other cases, the bins are formed from multiple pieces that enable designers to construct creative shapes and/or tailor the bins to meet particular consumer tastes. Multiple-piece bins generally take the form of a base portion to which is attached a unique facade. The facade can either be opaque or transparent and shaped or formed with various designs that enable the bin to blend or otherwise compliment aesthetic features present in the refrigerator.

The prior art contains a number of examples of multi-piece bins, as well as methods of attaching a facade to a base portion. Ideally, the base portion is designed so as to cooperate with a wide range of appliance platforms and to accept a wide variety of facades. In this manner, a single base portion can be employed to create a number of different storage bin configurations for use in various appliance models. The prior art contains examples of securing facades to the base portion through use of adhesives, sonic welding or through a simple snap-in arrangement. While each method has a particular advantage, the snap-in arrangement results in lower manufacturing costs.

Despite the existence of multi-piece storage bins in the prior art, there still exists a need for simple, cost effective and robust mounting arrangements for securing facades to bases of multi-piece storage bins.

SUMMARY OF THE INVENTION

The present invention is directed to storage bin assembly that can be selectively and removably mounted to an inner liner of a refrigerator door. In accordance with the invention, the storage bin assembly includes a base portion, along with a facade or face portion. The base portion includes front, bottom, rear and opposing side walls that collectively define a storage cavity. The front wall is formed with a frontal opening that is collectively defined by first and second side portions and a bottom portion of the front wall.

In further accordance with the invention, each of the first and second side portions of the front wall is provided with both a mounting element and a mounting component. Additionally, the bottom portion of the front wall is provided with a recess for receiving a bottom section of the face portion. Furthermore, side sections of the face portion are provided with both mounting members that engage with the mounting component on the frontal wall and a mounting part that engages with the mounting element of the frontal wall to detachably secure the face portion to the base portion.

In accordance with one embodiment, the mounting component and mounting element are constituted by a slot and a depression respectively. The mounting member and mounting part are constituted by a raised rib and a flange respectively. In addition, each side portion is provided with a boss or pin. With this arrangement, the pin is inserted into the slot. Thereafter, the face portion is shifted until the raised rib snaps into the slot in order to secure the face portion in the frontal opening of the base portion. Once in place, the flange nests within the depression to prevent forward excursion of the face portion.

In accordance with another embodiment, the mounting element and mounting component are constituted by first and second notches formed in a rear surface of the first and second side portions, while the mounting member and mounting part are constituted by first and second fingers that project from each of the opposing side sections of the face portion. Each notch opens into a slot that extends toward the bottom portion of the front wall. To mount a face portion to a base portion of a storage bin assembly constructed in accordance with this embodiment, the fingers are initially aligned with and inserted into respective notches. Thereafter, the face portion is shifted downward such that the fingers are retained within the slot. To provide a more robust attachment, a recessed portion of the front wall is provided with at least one aperture, and the bottom section of the face portion includes a tab. When the face portion is shifted into place, the tab extends into the aperture and engages the base portion.

In accordance with other embodiments of the present invention, the recess formed in the bottom portion of the front wall is provided with structure to properly align the face portion with the base portion. In accordance with a third embodiment of the invention, the structure is constituted by a guide member that extends across the frontal opening at the recess. In accordance with a fourth embodiment of the invention, the structure is constituted by mounting blocks arranged in the recess.

Additional objects, features and advantages of the present invention will become more readily apparent from the following detailed description of the preferred embodiments when taken in conjunction with the drawings wherein like reference numerals refer to corresponding parts in the several views.

DETAILED DESCRIPTION OF THE PREFERRED EMBODIMENTS

Figure 1:
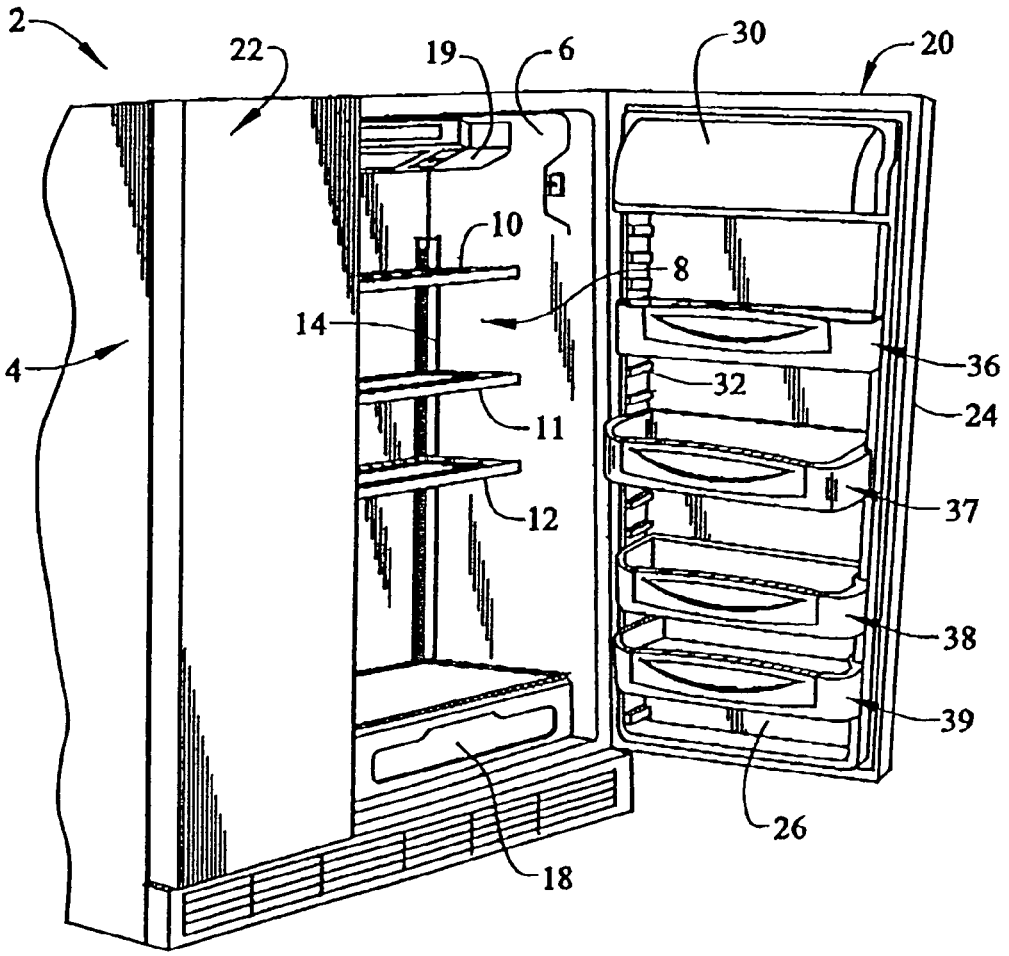
FIG. 1 is a partial, perspective view of a side-by-side refrigerator incorporating a storage bin assembly constructed in accordance with the present invention.

With initial reference to FIG. 1, a refrigerator, generally indicated at 2, is shown to include a cabinet shell 4 which is provided with a liner 6. As shown, liner 6 defines a fresh food compartment 8 which, in a manner known in the art, is provided with a plurality of shelves 10-12 for supporting various food articles and the like. Shelves 10-12 are adjustably mounted upon a pair of shelf rails, one of which is indicated at 14. Arranged below shelves 10-12 is a crisper bin 18 which, in a manner known in the art, provides a controlled environment for select food items. Positioned at an upper portion of fresh food compartment 8 is a control housing 19 which enables a consumer to set various settings for refrigerator 2.

In a manner known in the art, refrigerator 2 is also shown to include a fresh food door 20 which selectively extends across fresh food compartment 8. In a manner also known in the art, refrigerator 2 is provided with a freezer door 22 that selectively closes a freezer compartment (not shown). In any event, fresh food door 20 is shown to include an outer shell 24 and an inner liner 26. Arranged at an upper portion (not separately labeled) of inner liner 26 is a compartment 30 for holding butter and the like. Additionally, side portions (not separately labeled) of inner liner 26 are provided with a plurality of support rails one of which is indicated at 32, which enable a consumer to selectively position a plurality of storage bins 36-39 on inner liner 26. Although storage bins 36-39 could be formed in various ways, each storage bin 36-39 is preferably injection molded as two-pieces which are assembled as discussed further below with reference to storage bin 37.

Figure 2:
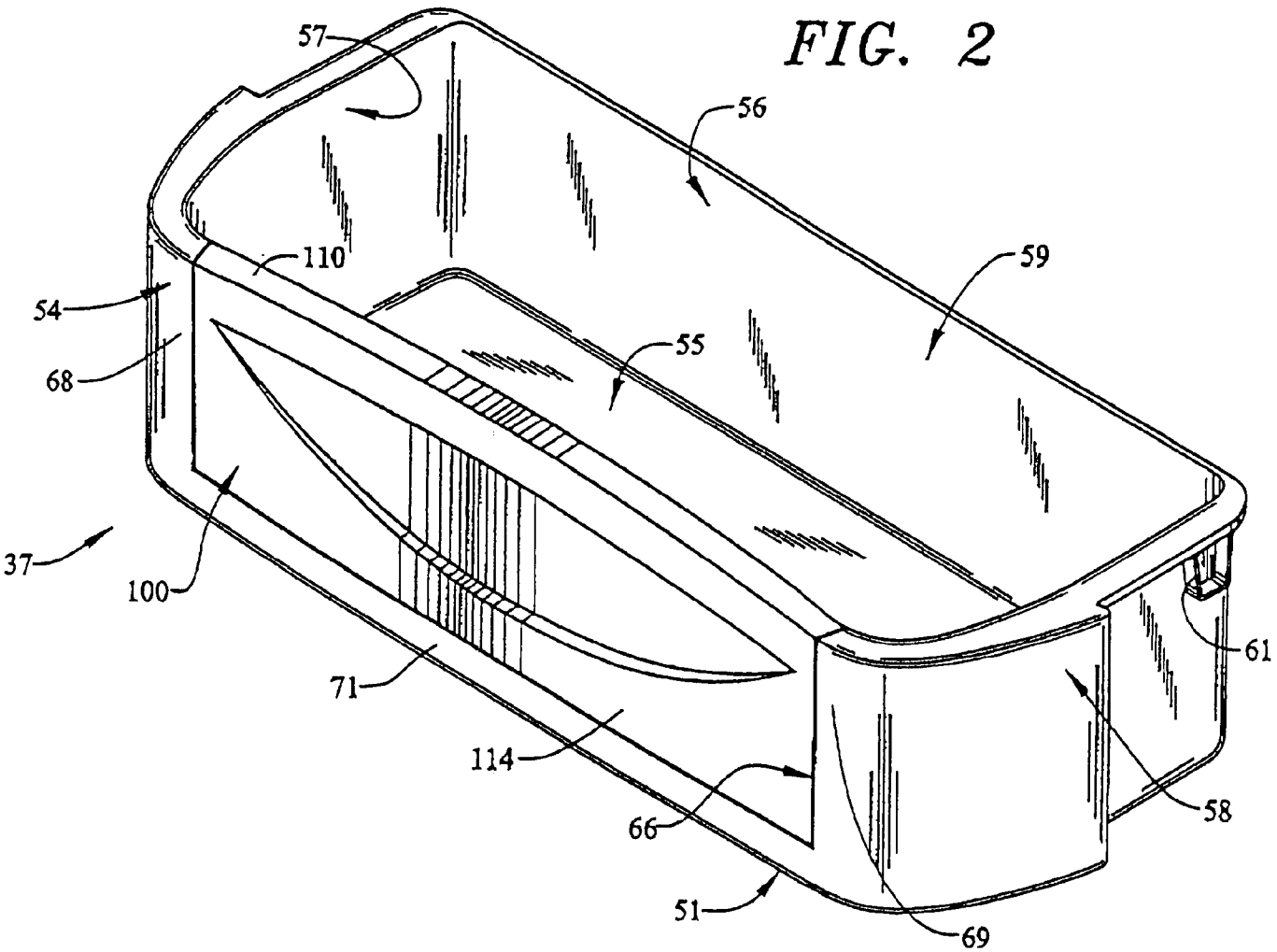
FIG. 2 is an upper right perspective view of the storage bin assembly constructed in accordance with the invention.
Figure 3:
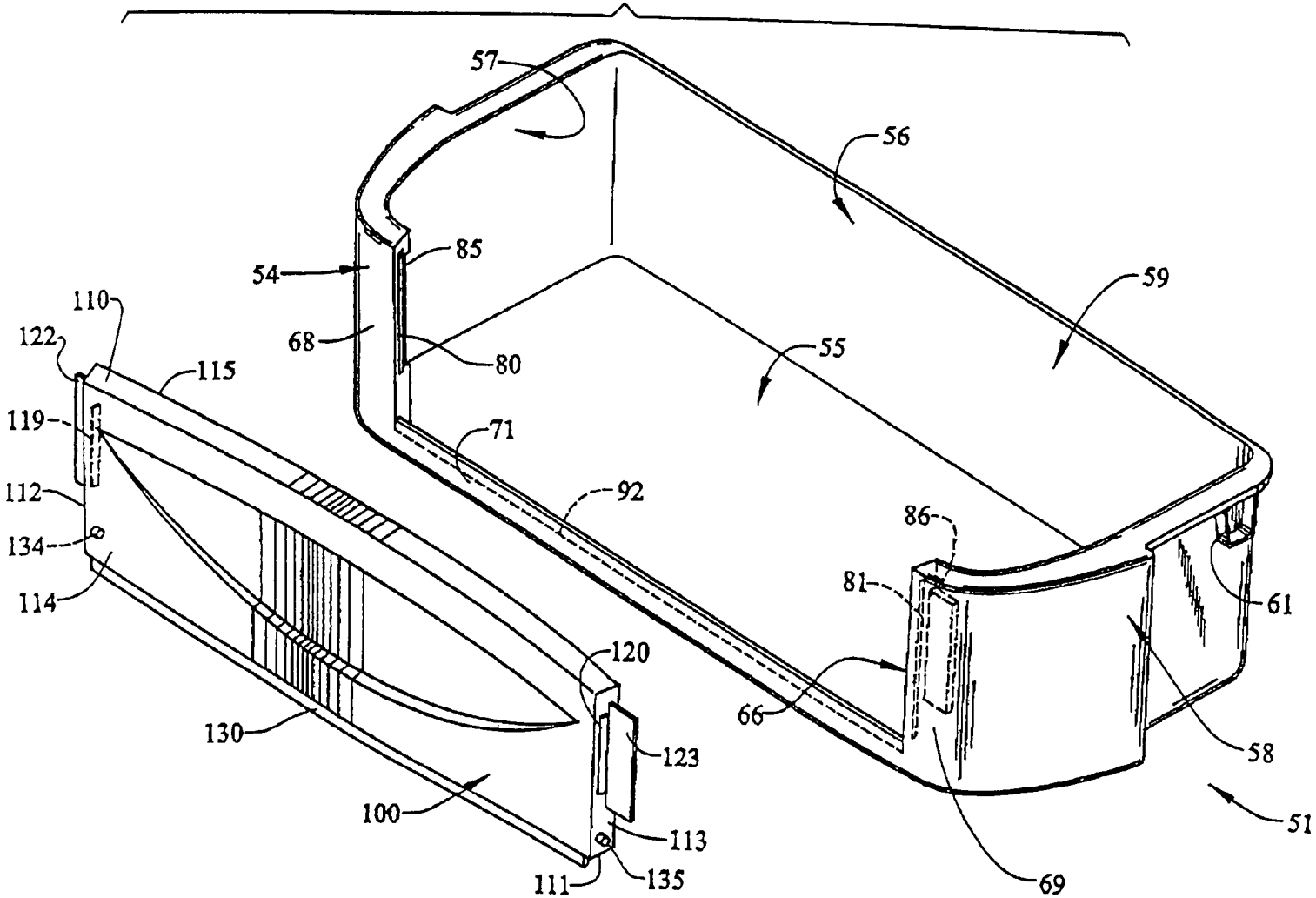
FIG. 3 is an exploded view of the storage bin assembly of FIG. 2.
Figure 4A:
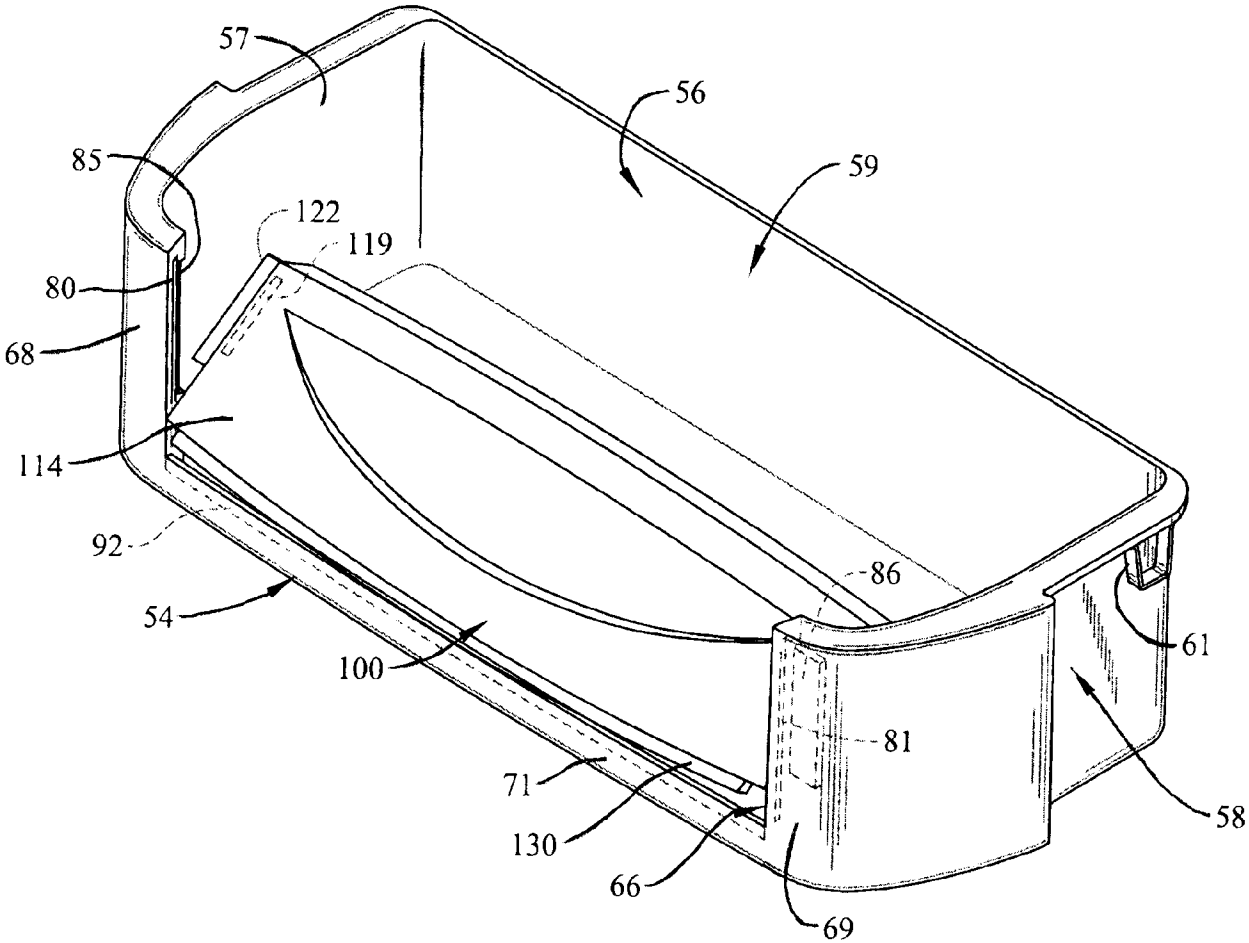
FIG. 4A is an upper right perspective view of the storage bin assembly of FIG. 2, illustrating a face portion of the storage bin assembly being secured to a base portion thereof.
Figure 4B:
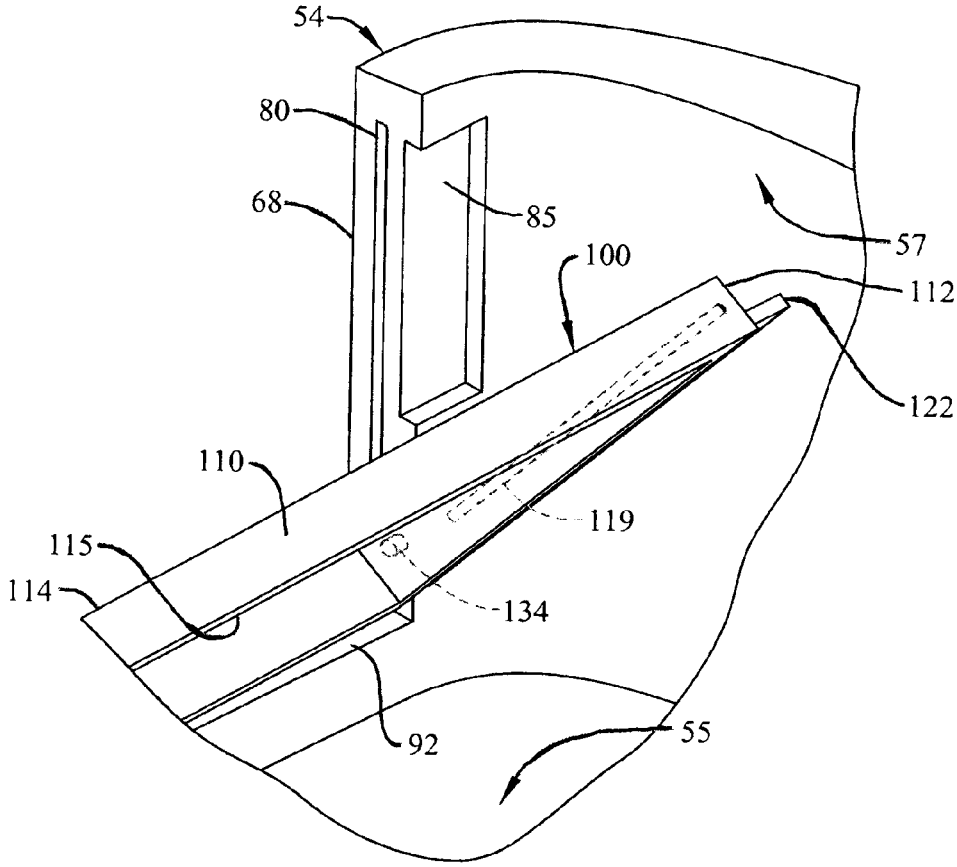
FIG. 4B is a detail view of a front corner portion of the storage bin assembly of FIG. 4A.

Reference will now be made to FIGS. 2-4 in describing storage bin 37 constructed in accordance with one preferred embodiment of the invention. As shown, storage bin 37 includes a base portion 51 having a front wall 54, bottom wall 55, rear wall 56, and opposing side walls 57 and 58 that collectively define a storage cavity 59. In a manner known in the art, arranged on each opposing side wall 57, 58 is a support lug 61. Support lug 61 is designed to cooperate with support rails 32 on inner liner 26 to position and retain storage bin 37 on fresh food door 20. As best shown in FIGS. 3 and 4, base portion 51 includes a frontal opening 66 defined by a first side portion 68, a second side portion 69 and a bottom portion 71 of front wall 54.

In accordance with the invention, first and second side portions 68 and 69 are provided with corresponding first and second mounting components 80 and 81. First and second side portions 68 and 69 are also provided with corresponding first and second mounting elements 85 and 86. In accordance with the embodiment shown, first and second mounting components 80 and 81 are constituted by slots formed in first and second side portions 68 and 69 respectively, while first and second mounting elements 85 and 86 are constituted by depressions formed on a rear side (not separately labeled) of first and second side portions 68 and 69. In addition, bottom portion 71 is provided with a recess 92 that, in combination with mounting components 80 and 81 and mounting elements 85 and 86, function to retain a face portion 100 of storage bin 37 across frontal opening 66. Preferably, face portion 100 is formed from a plastic-like material that can be either transparent or opaque. In addition, face portion 100 can be molded with various different designs depending upon the particular model type of refrigerator 2 into which storage bin 37 is to be incorporated.

In any event, regardless of the particular material used, face portion 100 includes a top section 110, a bottom section 111 and opposing side sections 112 and 113 which surround a front surface 114 and a rear surface 115. In accordance with the embodiment shown, opposing side sections 112 and 113 are provided with corresponding first and second mounting members 119 and 120, as well as first and second mounting parts 122 and 123. As shown, each mounting member 119, 120 is constituted by a raised, laterally projecting rib, while each mounting part 122, 123 is constituted by a lateral flange. In order to secure face portion 100 to base portion 51 while, at the same time, prevent forward excursion of face portion 100 beyond front wall 54, mounting members 119 and 120 are adapted to interengage with mounting components 80 and 81 on first and second side portions 68 and 69. In addition, mounting parts 122 and 123 are formed so as to engage with, and actually nest within, mounting elements 85 and 86. Furthermore, in order to ensure that a seamless fit is achieved between face portion 100 and base portion 51, bottom section 111 is provided with a lip 130 that projects within recess 92 in bottom portion 71. To still further aid in the overall positioning and mounting of face portion 100 to base portion 51, a respective pin or boss 134, 135 is provided on a lower section (not separately labeled) of each opposing side section 112 and 113.

Face portion 100 is actually snap-fittingly secured to base portion 51 through interengagement of mounting members 119 and 120 with mounting components 80 and 81, as well as the engagement of mounting parts 122 and 123 with mounting elements 85 and 86. More specifically, with particular reference to FIG. 4, pins 134 and 135 are initially positioned within first and second mounting components 80 and 81. At this point, face portion 100 is rotated upward so that first and second mounting members 119 and 120 snap into first and second mounting components 80 and 81 while the first and second mounting parts 122 and 123 abut and nest within mounting elements 85 and 86. With lip 130 resting within recess 92, an overall seamless appearance is established for storage bin 37 as clearly represented in FIG. 2.

Figure 5:
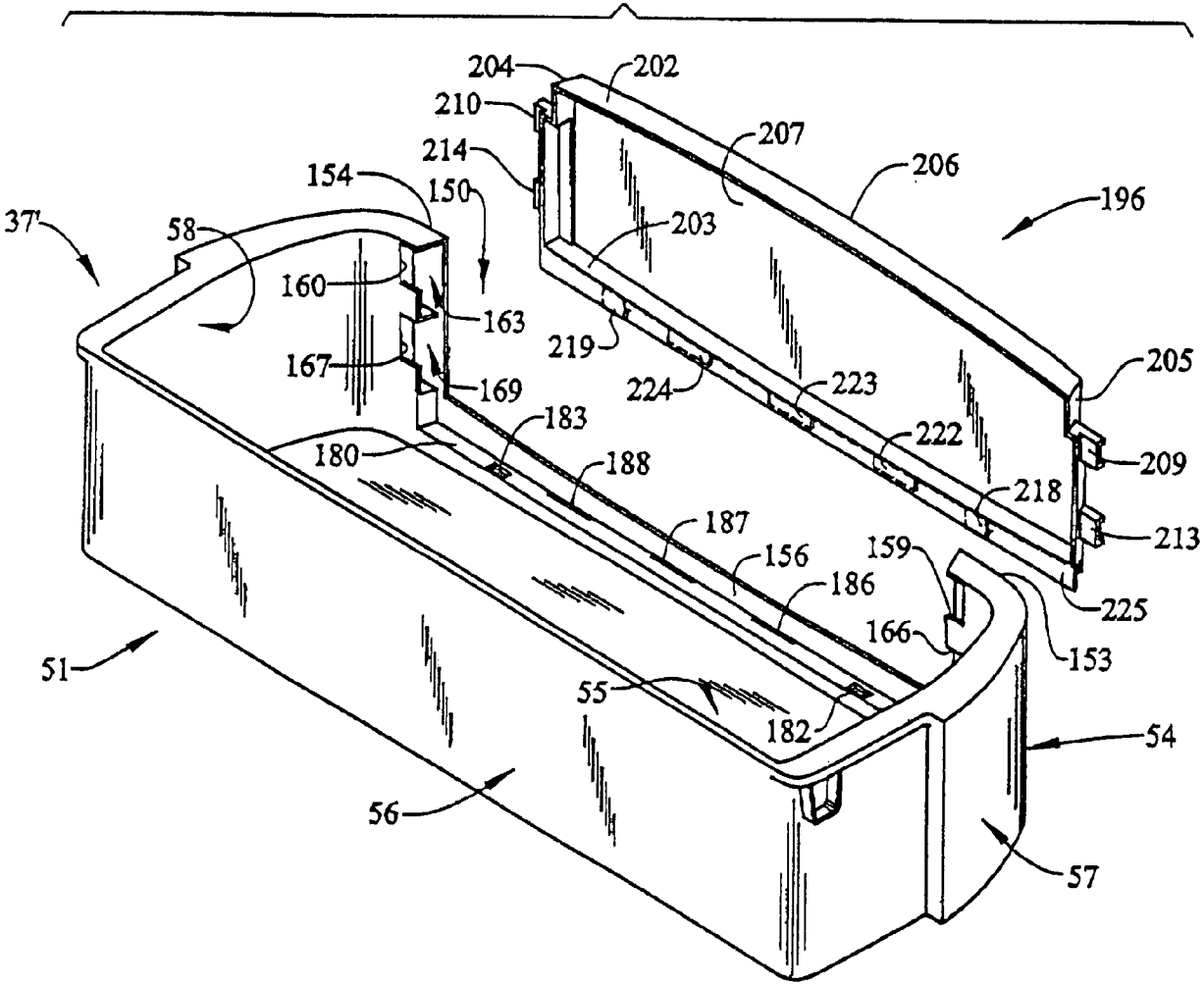
FIG. 5 is an exploded, upper rear perspective view of a storage bin assembly constructed in accordance with a second embodiment of the present invention.
Figure 6:
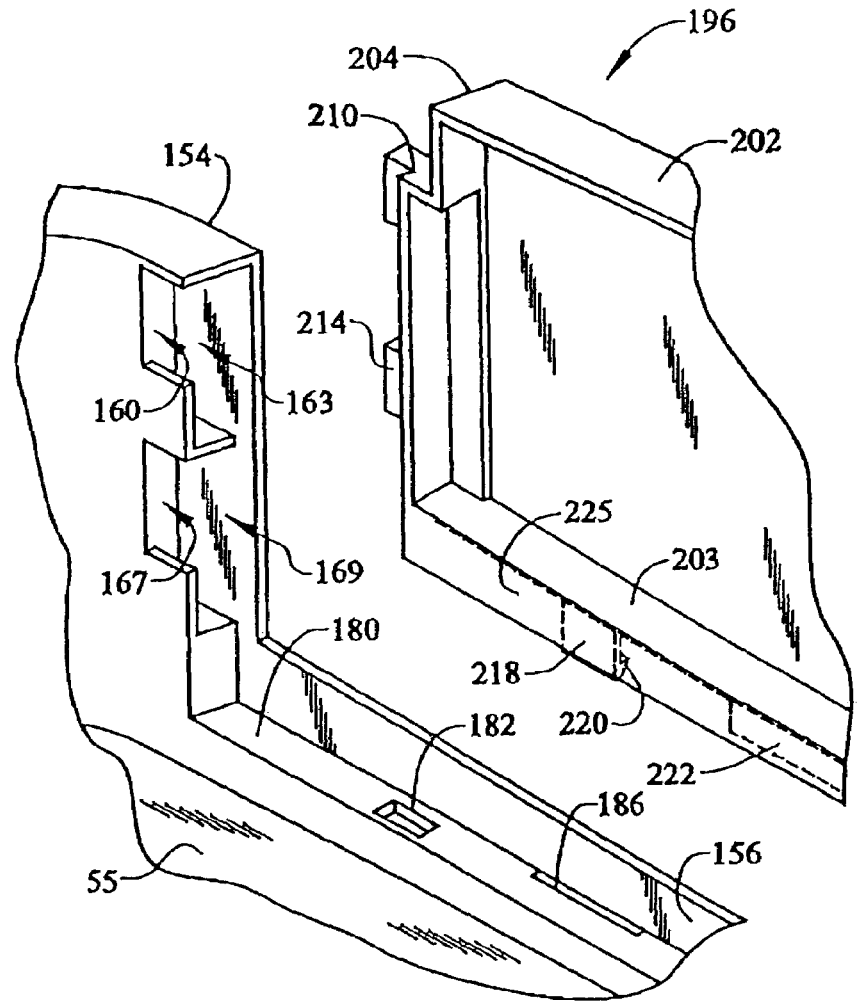
FIG. 6 is a detail view of a front corner portion of the storage bin assembly of FIG. 5.
Figure 7:
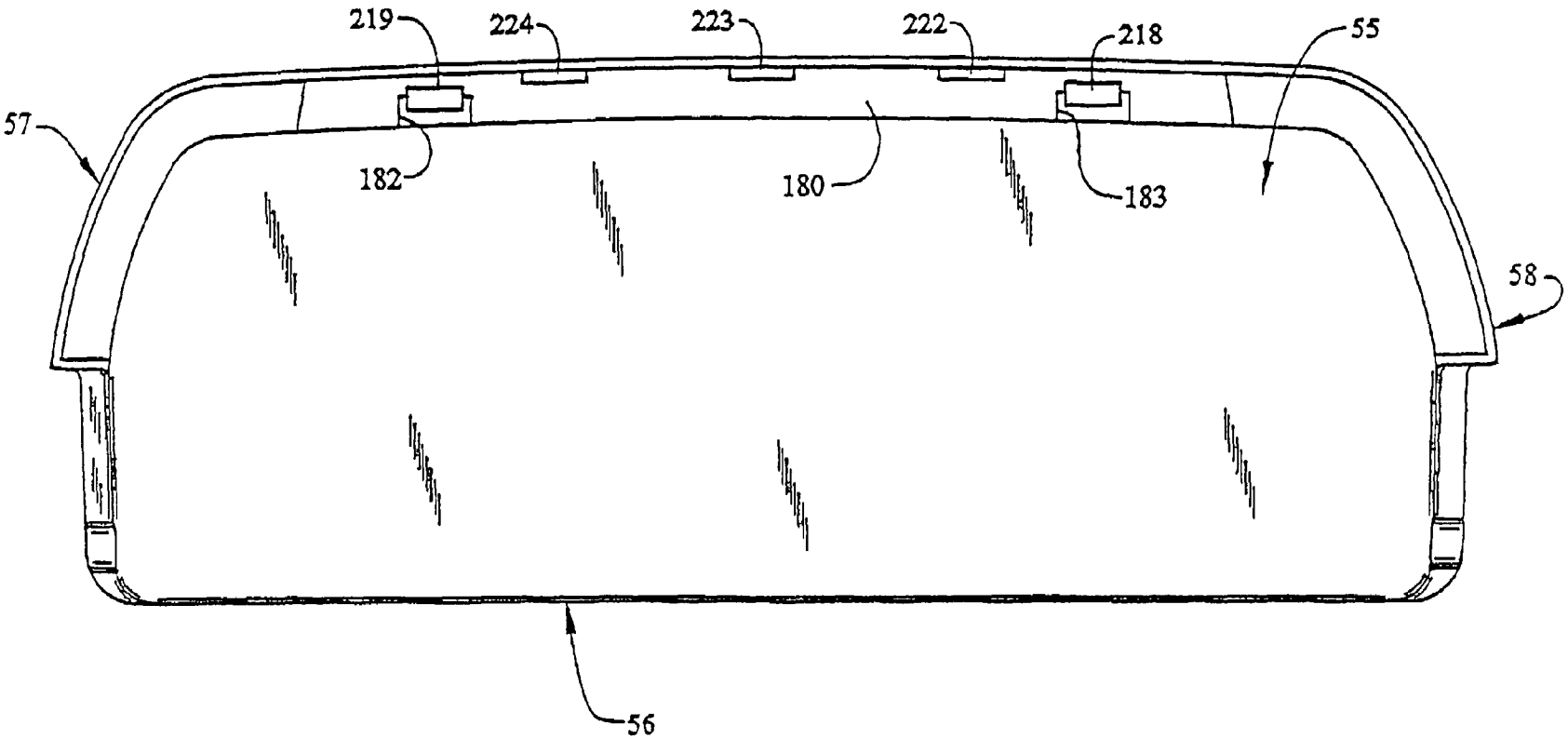
FIG. 7 is a bottom view of the storage bin assembly of FIG. 5.

Reference will now be made to FIGS. 5-7 in describing a second embodiment of the present invention where like reference numbers refer to corresponding parts in the various views. In accordance with the embodiment shown, a of storage bin 37' includes a base portion 51 that is provided with a frontal opening 150. Frontal opening 150 includes first and second side portions 153 and 154, as well as a bottom portion 156. Each side portions 153, 154 is provided with mounting components 159 and 160 defined by openings formed in rear sections (not separately labeled) of side portions 153 and 154. Mounting components 159 and 160 are constituted by notches that lead into respective slots, one of which is shown at 163. In addition to mounting components 159 and 160, side portions 153 and 154 are provided with mounting elements 166 and 167 which are also defined by notches formed on rear sections (not separately labeled) of side portions 153 and 154 that lead into respective slots, such as indicated at 169. In the embodiment shown, mounting elements 166 and 167 are actually positioned below mounting components 159 and 160. In addition, bottom portion 156 is provided with a recess 180 having a plurality of openings 182 and 183, as well as a plurality of slots 186-188, the details of which will be provided more fully below.

In a manner similar to that described above, frontal opening 150 is adapted to receive a face portion 196 that provides a seamless appearance for storage bin 37'. Toward that end, face portion 196 includes a top section 202, a bottom section 203 and opposing side sections 204 and 205 which define a front surface 206 and a rear surface 207. Each opposing side section 204, 205 includes a corresponding mounting member 209, 210, as well as a corresponding mounting parts 213, 214. In the embodiment shown, each mounting member 209, 210 and mounting parts 213, 214 is constituted by a square-shaped lug or finger which is adapted to engage with a corresponding one of mounting components 159 and 160 and mounting elements 166 and 167. In addition, bottom section 203 is provided with a plurality of clips 218 and 219, each having an associated hook element 220 (see FIG. 6) that are sized to extend into openings 182 and 183 respectively. In order to ensure proper positioning of face portion 196, a plurality of tabs 222-224 are also formed on bottom section 203 and are designed to extend into slots 186-188 respectively. Finally, bottom section 203 is also provided with a lip 225 used in mounting face portion 196 as detailed further below.

With this construction, face portion 196 is joined to base portion 51 by simultaneously aligning and inserting mounting members 209 and 210 and mounting parts 213 and 214 into mounting components 159 and 160 and mounting elements 166 and 167 respectively. At this point, face portion 196 is shifted downward such that mounting members 209 and 210 and mounting parts 213 and 214 move through slots 163 and 169 allowing clips 218 and 219 and tabs 222-224 to extend through openings 182 and 183 and slots 186-188 respectively. Once face portion 196 is fully seated, hooks 220 and 221 engage with bottom portion 55 of base portion 51, while a rear surface of side portions 153 and 154 retain mounting members 209 and 210 and mounting parts 213 and 214 to snap-fittingly retain face portion 196 to base portion 51.

Figure 8:
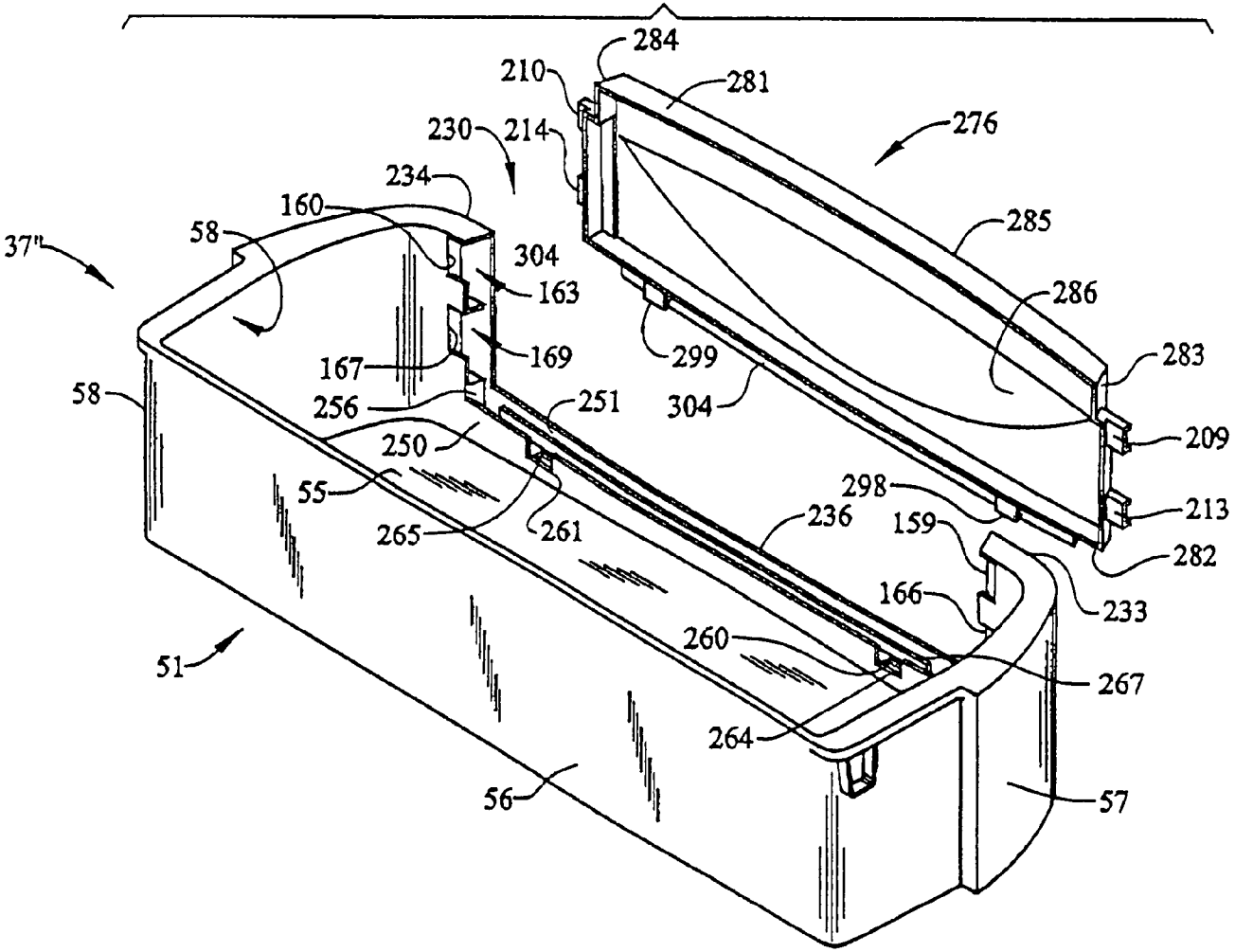
FIG. 8 is an exploded, upper rear perspective view of a storage bin assembly constructed in accordance with a third embodiment of the present invention.
Figure 9:
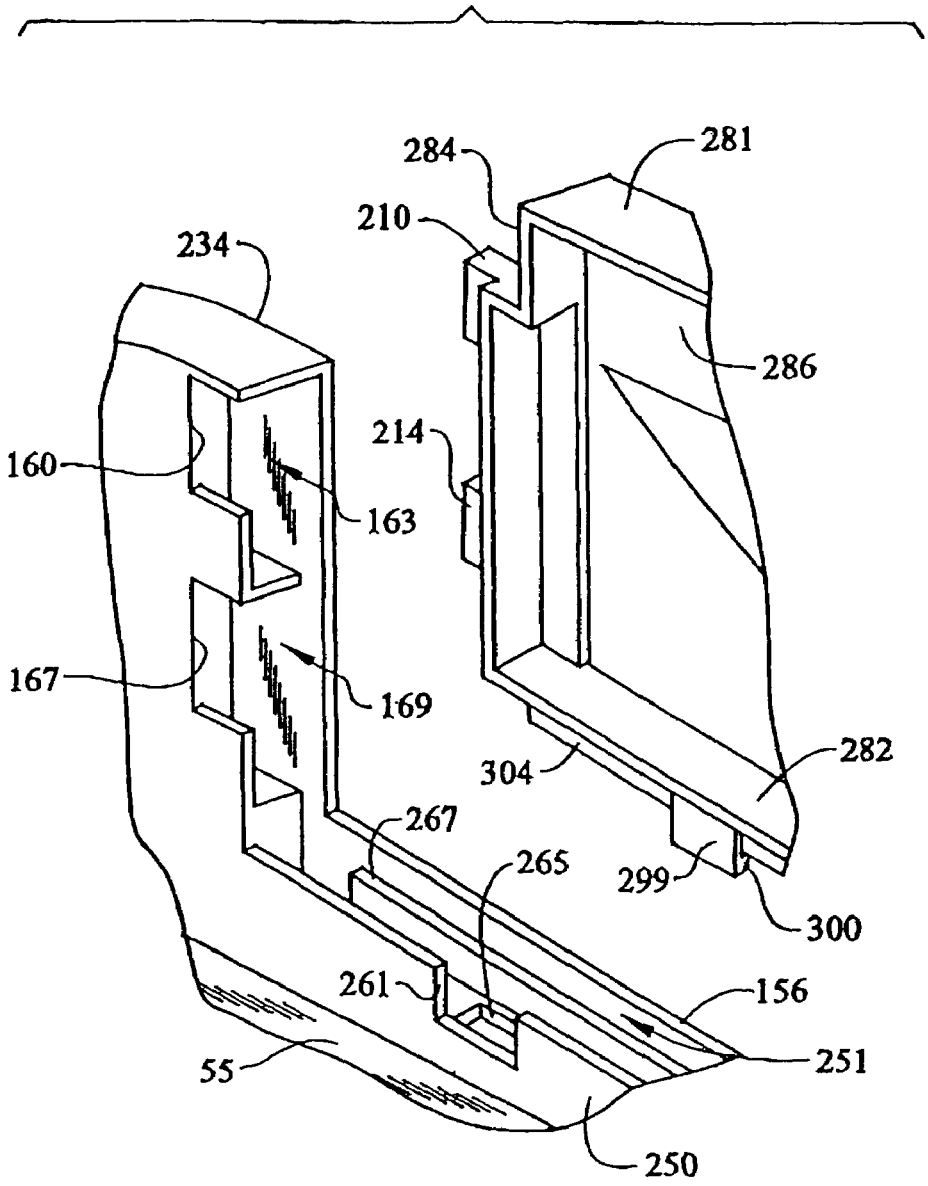
FIG. 9 is a detail view of a front corner portion of the storage bin assembly of FIG. 8.
Figure 10:
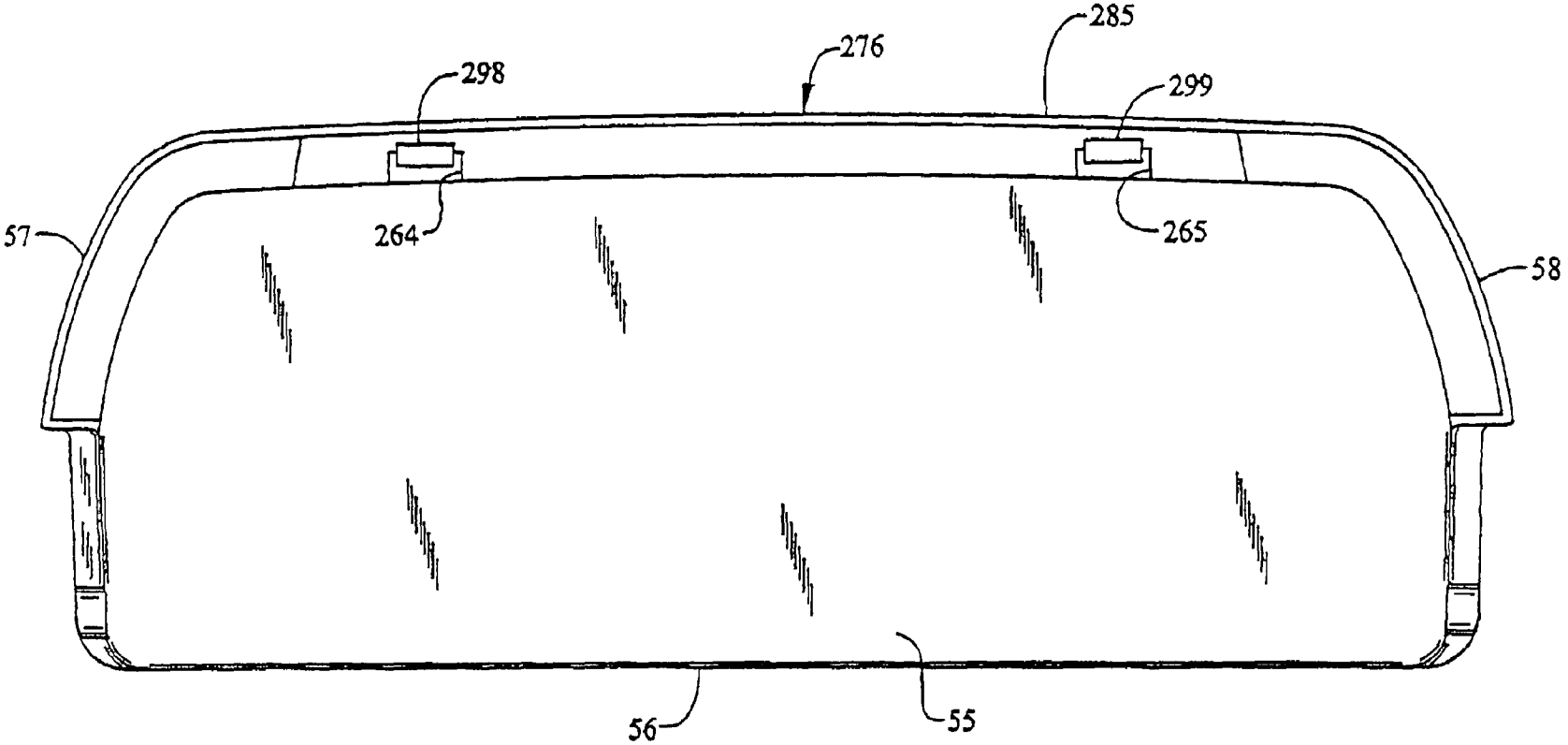
FIG. 10 is a bottom view of the storage bin assembly of FIG. 8.

Reference will now be made to FIGS. 8-10 in describing a third embodiment of the present invention wherein like reference numbers refer to corresponding parts in the various views. As shown, storage bin 37" includes a base portion 51 having a frontal opening 230. Frontal opening 230 includes first and second side portions 233 and 234, as well as a bottom portion 236. In a manner similar to that described above with respect to frontal opening 150, first and second side portions 233 and 234 include corresponding first and second mounting components 159 and 160 defined by notches or openings that lead into a slot 163. Likewise, side portions 233 and 234 are provided with corresponding first and second mounting elements 166 and 167 which lead into associated slots 169.

In further accordance with the embodiment shown, bottom portion 236 includes an inner wall portion 250 spaced from an outer wall portion 251 by a central recess 256. Inner wall portion 250 includes a pair of notches 260 and 261 which are positioned adjacent openings 264 and 265 provided in recess 256. In addition to openings 264 and 265, a guide member 267 is formed within recess 256 which assists in the overall positioning of a front face portion 276 in a manner as will be discussed more fully below.

In a manner similar to that described with respect to the previous embodiments, a frontal opening 230 is fitted with a face portion 276 including a top section 281, a bottom section 282, opposing side sections 283 and 284, a front surface 285 and a rear surface 286. Opposing side sections 283 and 284 of face portion 276 are provided with corresponding first and second mounting members 209 and 210 as well as corresponding first and second mounting parts 213 and 214. Mounting members 209 and 210 and mounting parts 213 and 214 are adapted to interengage with mounting components 159 and 160 and mounting elements 166 and 167 respectively. In accordance with the embodiment shown, bottom section 282 of face portion 276 is formed with a pair of clips 298 and 299, each having a corresponding hook 300 (see FIG. 9). In addition, bottom section 282 is provided with a web section 304 which extends substantially perpendicularly from bottom section 282 and preferably interconnects clips 298 and 299.

In accordance with the present embodiment, face portion 276 is placed within bottom portion 51 such that mounting members 209 and 210 and mounting parts 213 and 214 align with corresponding ones of mounting components 159 and 160 and mounting elements 166 and 167. Likewise, clips 298 and 299 must be aligned with notches 264 and 265 formed in inner wall section 250. At this point, face portion 276 is shifted forward such that each of the aforementioned components intergage, causing front surface 285 to be substantially coplanar with front wall 54. At this point, face portion 276 is shifted downward such that mounting members 209 and 210 and mounting parts 213 and 214 respectively nest within mounting components 159 and 160 and mounting elements 166 and 167. In addition, clips 298 and 299 extend through and secure within openings 264 and 265, while web section 304 rides against guide member 267 ensuring that front surface 285 provides a seamless appearance.

Figure 11:
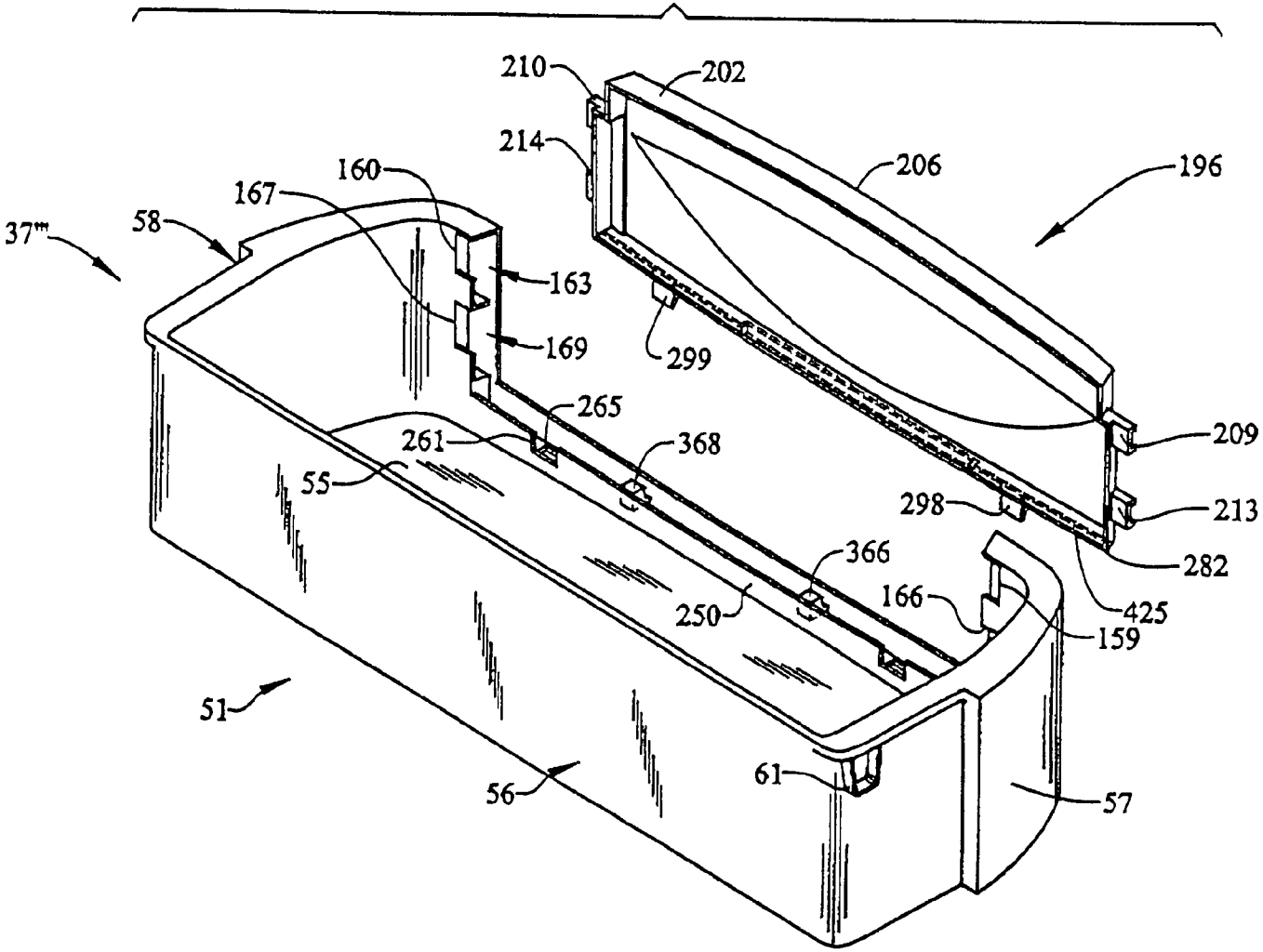
FIG. 11 is an exploded, upper rear perspective view of a storage bin assembly constructed in accordance with a fourth embodiment of the present invention.

In accordance with a still further form of the invention shown in FIG. 11, instead of guide member 267, bottom section 282 of storage bin 37''' is provided with a pair of guide blocks 366 and 368 which cooperate with a positioning element 425 formed on bottom section 282 of front face portion 276. Positioning element 425 cooperates with guide blocks 366 and 368 to ensure that front surface 285 and front portion 156 are substantially co-planar providing for a seamless, finished appearance. In any event, it should be recognized that the present invention allows for a simple and robust mounting arrangement for securing a facade or front face portion to a base portion so as to form or establish a multi-piece storage bin for mounting in a refrigerator.

Although described with reference to preferred embodiments of the invention, it should be readily understood that various changes and/or modifications can be made to the invention without departing from the spirit thereof. In general, the invention is only intended to be limited by the scope of the following claims.

We claim:

1. A refrigerator comprising:

a cabinet shell;

a liner disposed in the cabinet shell that defines at least a fresh food compartment;

a door pivotally mounted relative to the cabinet for selectively closing the fresh food compartment, said door including an outer shell and an inner liner; and a storage bin assembly detachably supported on the inner liner of the door, said storage bin assembly including:

a base portion having front, bottom, rear and opposing side walls, said front wall including a frontal opening collectively defined by first and second side portions and a bottom portion, each of said first and second side portions including a mounting component and a mounting element spaced from the mounting component; said bottom portion being provided with a recess; and a face portion mounted in the frontal opening such that the face portion is surrounded by the front wall of the base portion, said face portion including top, bottom and opposing side sections, each of said side sections including a mounting member and a mounting part spaced from the mounting member, wherein said bottom section is nested in said recess, said mounting member is interengaged with a respective said mounting component and the mounting part is interengaged with a respective said mounting element to secure the face portion to the base portion.

2. The refrigerator according to claim 1, wherein each of the mounting elements is constituted by a depression formed in a respective one of the first and second side portions of the front wall.

3. The refrigerator according to claim 2, wherein each of the mounting members is constituted by a raised rib.

4. The refrigerator according to claim 3, wherein each of the mounting components is constituted by a slot formed on a respective one of the first and second side portions, with said slot receiving a respective said raised rib.

5. The refrigerator according to claim 4, wherein each of the opposing side sections of the face portion is provided with a respective boss, with said boss being received in a respective said slot for pivotally interconnecting the face portion to the base portion.

6. The refrigerator according to claim 2, wherein each of the mounting parts is constituted by a flange, with said flange being nested in a respective said depression.

7. The refrigerator according to claim 2, wherein the bottom section of the face portion includes a lip, said lip being nested within the recess formed in the bottom portion of the base portion.

8. The refrigerator according to claim 1, wherein each of the mounting elements is constituted by a notch formed in a respective one of the first and second side portions.

9. The refrigerator according to claim 8, wherein each of the mounting components is constituted by a notch formed in the rear surface of a respective one of the first and second side portions.

10. The refrigerator according to claim 8, wherein each of the mounting members is constituted by a finger extending from a respective one of the opposing side sections of the face portion.

11. The refrigerator according to claim 10, wherein each of the mounting parts is constituted by a finger extending from a respective one of the opposing side sections of the face portion.

12. The refrigerator according to claim 8, wherein the bottom portion of the base portion includes inner and outer wall portions, said inner and outer wall portions collectively defining the recess.

13. The refrigerator according to claim 12, further comprising:

at least one aperture opening into the recess; and at least one clip projecting from the bottom section of the face portion, said clip being formed with a hook extending through the at least one aperture and snap-fittingly engaging the bottom wall of the base portion.

14. A storage bin assembly for an inner liner of a door of a refrigerator comprising:

a base portion having front, bottom, rear and opposing side walls, said front wall having first and second side portions and a bottom portion, the portions defining a frontal opening, each of said first and second side portions including a mounting component and a mounting element spaced from the mounting component, said bottom portion being provided with a recess; and a face portion mounted in the frontal opening such that the face portion is surrounded by the front wall of the base portion, said face portion including top, bottom and opposing side sections, each of said side sections including a mounting member and a mounting part spaced from the mounting member, wherein said bottom section is nested in said recess, said mounting member is interengaged with a respective said mounting component and the mounting part is interengaged with a respective said mounting element to secure the face portion to the base portion, wherein the storage bin assembly is adapted to be detachably supported on the inner liner of the door.

15. A method of assembling a refrigerator storage bin including a base portion having front, bottom, rear and opposing side walls, the front wall having first and second side portions and a bottom portion, the portions defining a frontal opening, and a face portion including top, bottom and opposing side sections comprising:

engaging a mounting member, located on one of the opposing side sections of the face portion, with a corresponding mounting component provided on a respective one of the side portions of the front wall of the base portion;

positioning a mounting part located on one of the opposing side sections of the face portion spaced from the mounting member with a corresponding mounting element provided on a respective one of the side portions of the front wall of the base portion and spaced from the mounting component; and snap-fittingly interconnecting the face portion in the frontal opening of the base portion by shifting the face portion relative to the base portion so as to inter-engage both the mounting member with the mounting component and the mounting part with the mounting element, such that the face portion is surrounded by the front wall of the base portion and the bottom section of the face portion extends into a recess provided along the bottom portion upon interconnecting the face portion to the base portion.

16. The method of claim 15, further comprising:

aligning a clip projecting from the bottom section of the face portion with an aperture formed in the bottom portion; and snap-fittingly engaging a hook member provided on the clip with the bottom wall of the storage bin through the aperture upon shifting of the face portion relative to the base portion.

17. The method of claim 15, further comprising: pivotally interconnecting the face portion to the base portion prior to snap-fittingly interconnecting the face portion in the frontal opening of the base portion.

18. The method of claim 15, wherein the face portion is shifted toward the bottom wall and substantially parallel to the rear wall of the base portion to snap-fittingly interconnect the face portion to the base portion.

19. The method of claim 15, wherein the face portion is shifted toward the front wall of the base portion to snap-fittingly interconnect the face portion to the base portion.

* * * * *